284812 0192 --00 02-19-91 45128 01-18-91 151418 78147.0 04993250 0612

United States Patent [19]

Platt

[11] Patent Number: 4,993,250

[45] Date of Patent: Feb. 19, 1991

[54] VARIABLE GEAR RATIO COILING MACHINE

[75] Inventor: Stephen A. Platt, Grand Haven, Mich.

[73] Assignee: S. A. Platt, Inc., Grand Haven, Mich.

[21] Appl. No.: 437,606

[22] Filed: Nov. 17, 1989

[51] Int. Cl.[5] ..... B21F 3/04

[52] U.S. Cl. ..... 72/145; 72/449

[58] Field of Search ..... 72/145, 135, 142, 449

[56] References Cited

U.S. PATENT DOCUMENTS

| | | | |
|---|---|---|---|
| 1,897,855 | 2/1933 | Nigro | 72/145 |
| 2,227,602 | 1/1941 | Platt | 153/64 |
| 2,868,267 | 1/1959 | Platt | 153/64 |
| 3,401,557 | 9/1968 | Platt | 72/145 |
| 4,208,896 | 6/1980 | Platt | 72/142 |
| 4,258,561 | 3/1981 | Platt | 72/142 |
| 4,561,278 | 12/1985 | Platt | 72/142 |
| 4,569,216 | 2/1986 | Platt | 72/138 |

*Primary Examiner*—Lowell A. Larson
*Assistant Examiner*—Michael J. McKeon
*Attorney, Agent, or Firm*—Price, Heneveld, Cooper, DeWitt & Litton

[57] ABSTRACT

A variable power input wire coiler for coiling wire of different diameters, singly, in tandem, or in triple form, there being interchangeable drive gears to the coiling rolls astraddle the mandrel, such gears being disconnectable from flexible drive shafts and replaceable with different diameter drive gears.

24 Claims, 4 Drawing Sheets

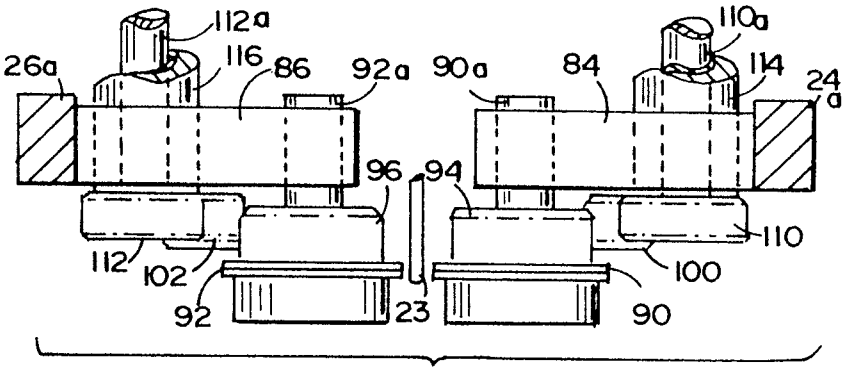
FIG. 6
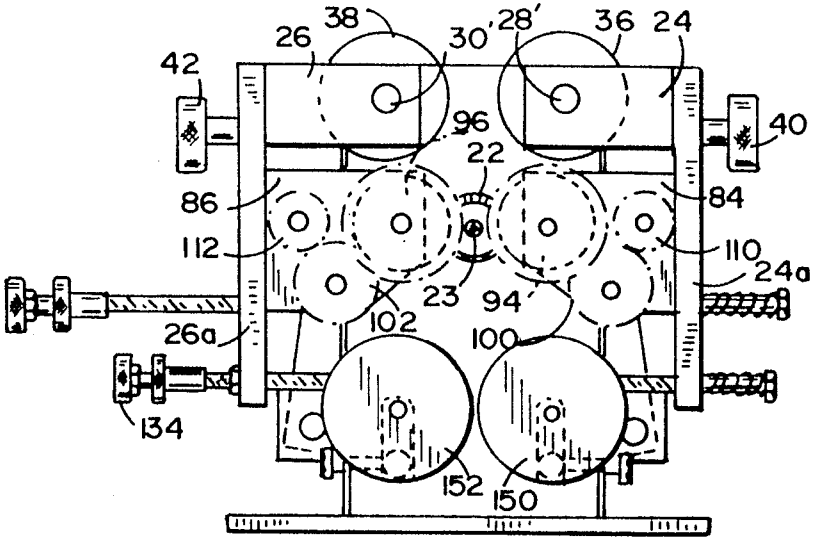
FIG. 3
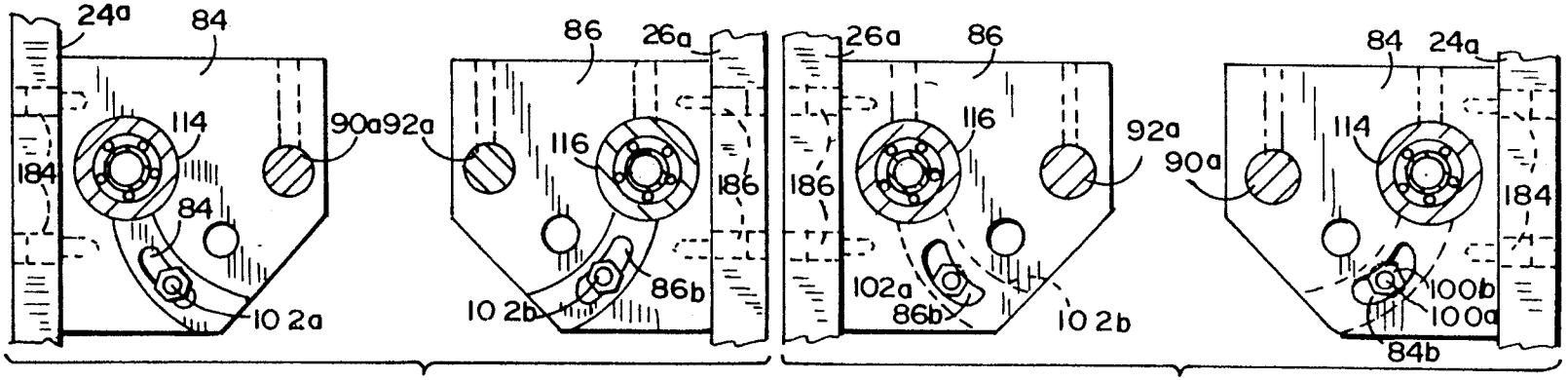
FIG. 9
FIG. 8

VARIABLE GEAR RATIO COILING MACHINE

BACKGROUND OF THE INVENTION

This invention relates to wire coiling machines. Wire coiling machine developments over the last several decades have enabled the coiling of smaller and smaller diameter wire as the products using such coils, e.g., heating elements, have become more and more sophisticated, such as for instrumentation. Coils must be of uniform structure from turn to turn, for controlled incremental resistance and heating, even though formed of wire as small in diameter as a human hair. Consequently, the inventions by the inventor herein have ranged from the coiler in U.S. Pat. No. 2,227,602 to those in U.S. Pat. Nos. 2,868,267, 3,401,557 and 4,208,896, 4,258,561, 4,561,278, and finally to that in U.S. Pat. No. 4,569,216. In patents such as U.S. Pat. No. 3,401,557, there is disclosed the use of flexible drive shafts and timing belts to drive the coiling rolls, enabling the machine to be capable of dependably coiling very fine wire.

In recent years, users of such wire coils have desired tandem coils, i.e., two wires coiled in twin arrangement, or even triple coils of three wires. Multiple wire coils are more energy effective, developing more heat per surface area than single wire coils. However, tandem coiling takes twice the power input to operate the coiling rolls, and triple coiling requires three times the power input.

Coil suppliers are required to make coils of wire varying in size between hairlike diameter, to form coils of small diameter, e.g., about 0.032 inch, to larger wire of a diameter of, e.g., 0.040 to 0.060 inch to form coils as of one inch in diameter. The very fine wire, difficult to see clearly without magnification lenses, is used for sophisticated instrumentation and the like, intermediate size wire and coils are used for electrical appliances such as stove burners and the like, while the larger diameter wire coils are used for such purposes as industrial heat treating furnaces. The power and coiling characteristics over this vast size range differ tremendously. Therefore, different coiling machines are employed to operate on these different sizes of wire, and even to accommodate the double and triple coils mentioned above.

It would be advantageous to have one coiler that could coil wire over the large size range encountered, and also coil tandem and triple wire stock. Moreover, the machine should preferably be rugged, simple and easy to set up and operate so as to be useful in various parts of the world, even in less technically developed countries.

SUMMARY OF THE INVENTION

A coiler has been developed by the inventor herein capable of producing coils over a large range of sizes from about 0.032 inch up to about one inch in diameter, as well as coiling tandem or triple wire coils. The novel coiler is capable of coiling hair size wire or wire such as 0.060 inch in diameter. It is rugged, enabling it to accommodate the larger power situations, yet accurate to coil the smallest wire. It is also simple and readily set up for the desired task, thereby being useful in parts of the world requiring sophisticated fine wire coils and also in less technically developed countries.

The novel coiler employs a special change gear system in a direct drive to the coiling rolls. This change gear system is incorporated in the coiling roll mounting section as a unit, able to pivot and work on the high helix angles required of tandem, triple and ribbon wire coiling. Drive gears are interchangeable on the support, being disconnectable from the flexible drive shafts which are axially shiftable relative to the other components.

The coiler transmits input power to a pair of driven rolls which rotate a pair of flexible drive cables releasably connected to a pair of drive gears. These drive gears engage a pair of shiftable idler gears which in turn engage driven gears on the coiler rolls astraddle the coiling mandrel. The pair of drive gears can be disconnected from the drive cables and replaced with different diameter drive gears for coiling a different diameter wire. When these drive gears are changed, the idler gears are arcuately shifted to engage the drive gears and also continue to maintain engagement with the driven gears on the coiler rolls.

The two coiler rolls on the two coiler units can be individually skewed for exact control of the coiling operation on selected wire size.

These and other objects, advantages and features of the invention will become apparent to those in the art upon studying the following specific description of a preferred exemplary embodiment, along with the drawings.

BRIEF DESCRIPTION OF THE DRAWINGS

FIG. 3 is a front elevational view of the coiler in FIG. 1 from the direction III;

FIG. 6 is a plan view of the front coiling end of the coiler;

FIG. 8 is a rear view of the gear support mount;

FIG. 9 is a front view of the gear support or mount; and

DESCRIPTION OF THE PREFERRED EMBODIMENT

Figure 1:
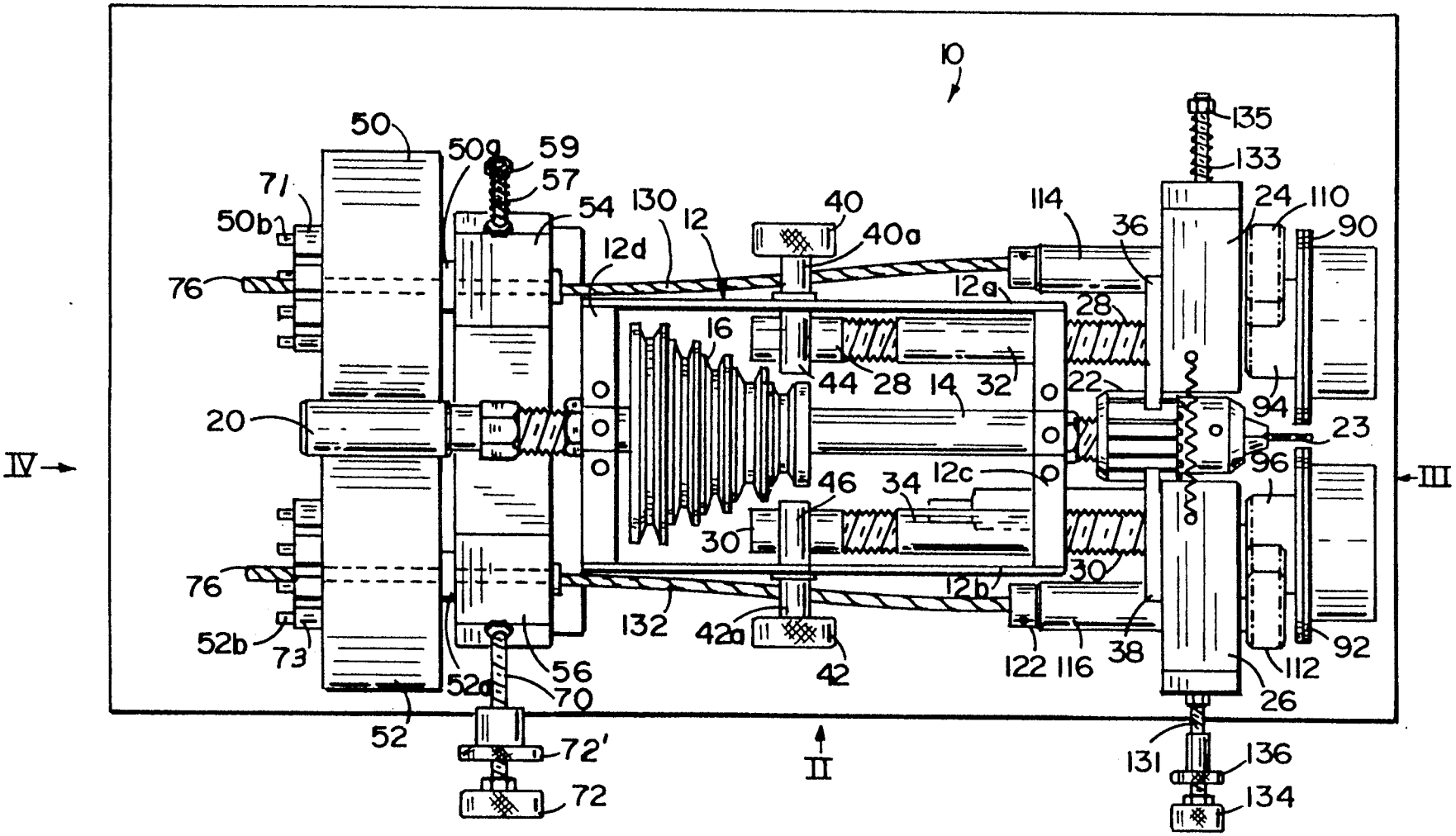
FIG. 1 is a plan view of a coiler assembly of this invention.

Referring now specifically to the drawings, the complete coiler apparatus 10 there depicted is built on and around a conventional support frame 12 composed of a pair of parallel vertical side plates **12*a* and 12*b* connected at their forward ends to a vertical front plate 12*c* and at their rear ends to a vertical rear plate 12*d*. Extending through the length of this support frame 12 at the center thereof, and specifically through bearings in front and rear plates 12*c* and 12*d*, is a central drive shaft spindle 14. It has a plurality of varying size drive pulleys 16 thereon and keyed thereto. A suitable belt (not shown) extending from a drive motor (not shown) drives the coiler components through a selected diameter pulley. Extending rearwardly from shaft 14 and mounted thereto behind rear plate 12***d* is a drive arbor 20 rotated by shaft 14. Extending from the forward end of shaft 14, i.e., forwardly of plate 12*c*, is a chuck 22, preferably a Jacobs chuck, which secures a selected size coiling arbor or mandrel 23 therein. Astraddle of the chuck is a pair of hangers 24 and 26 pivotally mounted on respective shafts 28 and 30 located above the level of drive shaft 14 (FIG. 2) and parallel to each other and to shaft 14 and mandrel 23. Shafts 28 and 30 are threadably interconnected with fixed collars 32 and 34, respectively. These collars are attached to front plate 12*c*. Also fixed to shafts 28 and 30 are knurled knobs 36 and 38, respectively, to rotate threaded shafts 28 and 30 within collars 32 and 34 and thereby axially adjust the individual positions of hangers 24 and 26 relative to each other. This change of position of the coiling rolls axially relative to each other accommodates the wire diameter to be coiled. The particular axial positions of shafts 28 and 30 can be retained by locking them using knurled knobs 40 and 42 which rotate their shafts 40*a* and 42*a*, respectively, to tighten conventional split block retainers 44 and 46 around the rear unthreaded ends of shafts 28 and 30. The angular orientation of the coiling rolls relative to each other and the coiling arbor can be adjusted by angularly shifting the mounting blocks 84 and 86 on which the coiling rolls are mounted, as explained more fully hereinafter.

Figure 2:
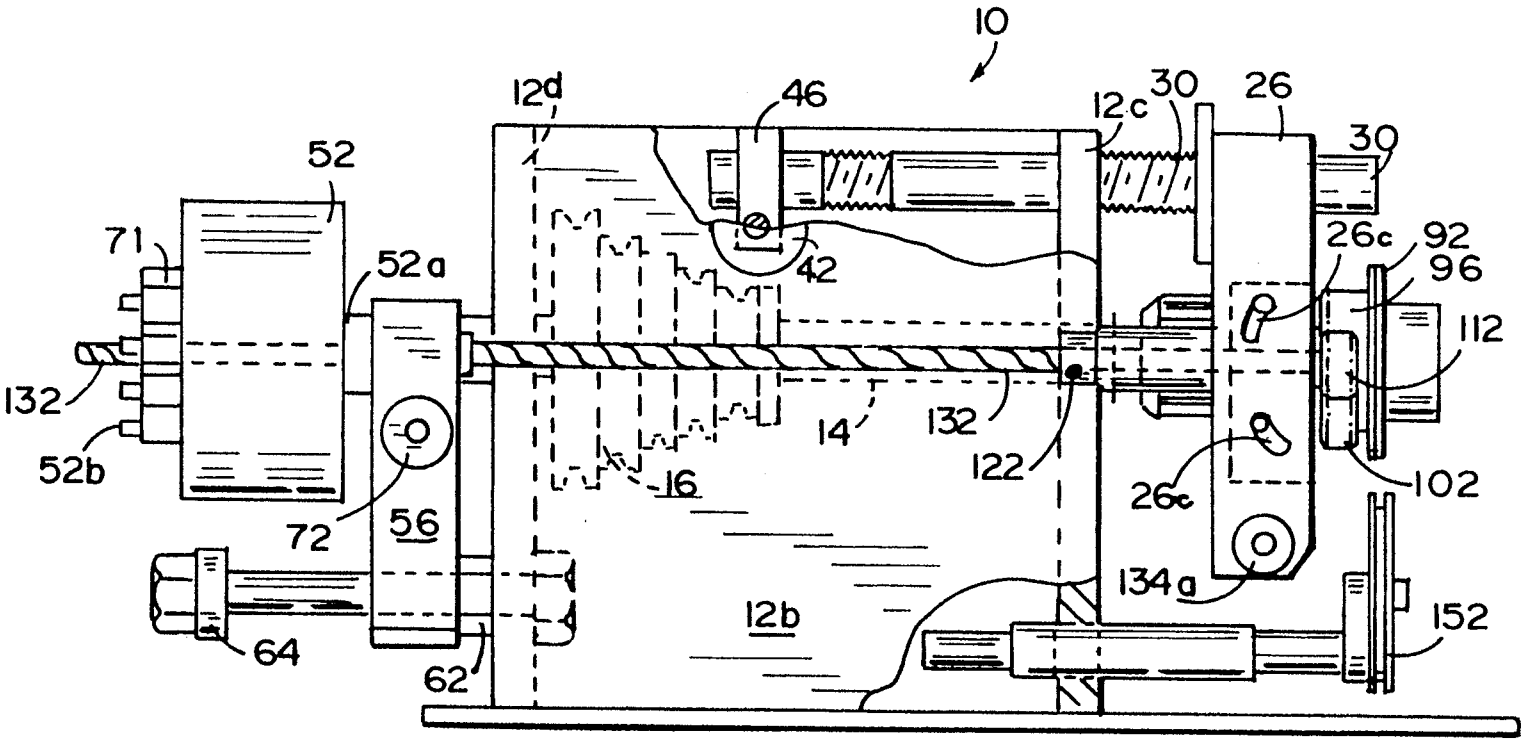
FIG. 2 is a side elevational view of the coiler in FIG. 1 from the direction II.
Figure 7:
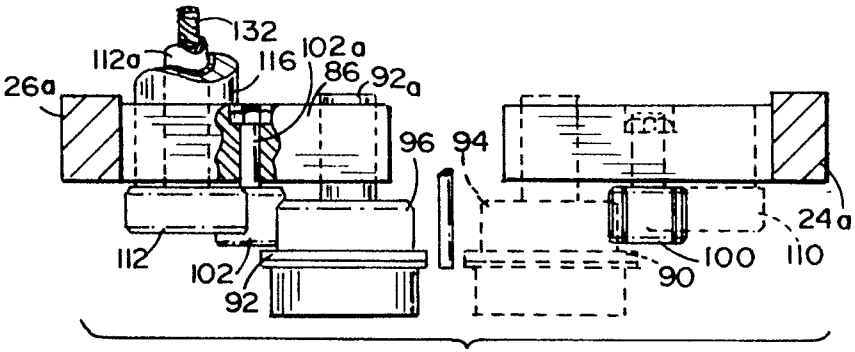
FIG. 7 is a plan view partially in phantom of the front end of the coiler, showing one size drive gear on one side and another size drive gear on the other side.
Figure 4:
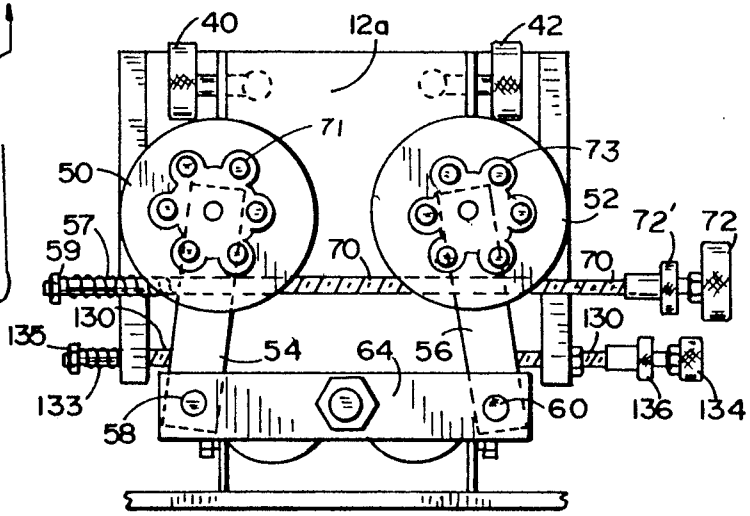
FIG. 4 is a rear elevational view of the coiler in FIGS. 1–3 from the direction IV.

Astraddle drive arbor 20 is a pair of friction drive rolls 50 and 52 which can be moved to tightly engage opposite sides of drive arbor 20. The periphery of these rolls has a high friction material such as neoprene rubber thereon. These drive rolls are mounted on respective axles 50*a* and 52*a* to a pair of pivot blocks 54 and 56, respectively (FIG. 1). The pivot blocks are mounted pivotally at their lower ends on a pair of pivot rods 58 and 60 (FIG. 4), the ends of which are anchored in a pair of parallel spaced horizontal cross bars 62 and 64 (FIGS. 2 and 4). A transversely oriented threaded hanger adjustment rod 70 with a control knob 72 and a lock knob 72 is threadably engaged with one of the hangers 56 and extends through the other hanger 54 which is biased toward the spindle by a compression coil spring 57 around the far end of rod 70. The spring 57 is held against block 54 by a nut 59 on rod 70. Rotation of rod 70 adjusts the pivotal position of the hangers and thus of rolls 50 and 52 relative to central drive arbor 20. This is to vary the amount of pressure applied by the rolls on the spindle for optimum drive conditions from drive arbor 20 to rolls 50 and 52.

Drive power is transmitted from the rear of the coiler to the front coiling rolls using a pair of flexible drive shafts. More specifically, extending from the rear of rolls 50 and 52 is a plurality of axially extending, radially offset, circumferentially spaced, elongated drive pins 50*b* and 52*b*, respectively, in generally circular fashion. Positioned on the drive pins is a pair of drive rings 71 and 73, each of which includes a plurality of radially offset, circumferentially spaced, axially extending hollow sleeves which slidably receive pins 50*b* and 52*b*, respectively, and which have a set screw (not shown) engaging the rear end portions of a pair of flexible cable-type drive shafts 74 and 76. These flexible drive shafts extend through rolls 50 and 52, respectively, through hangers 54 and 56, respectively, and on the outside of side plates 12*a* and 12*b* toward the front of the machine where they engage with a releasable connection to a pair of novel gear assemblies to be described.

At the front of the machine is the pair of hangers 24 and 26 previously noted. These hangers include an upper part pivotally mounted on the forwardly extending unthreaded ends 28' and 30' (FIG. 3) of shafts 28 and 30, and include downwardly depending parts 24*a* and 26*a*, respectively. A pair of gear and coiling roll mounting blocks 84 and 86 are bolted to the hangers, and specifically to hanger parts 24*a* and 26*a*. Each of these hanger parts has a pair of angular slots, e.g., see 26*c* (FIGS. 2 and 5), to receive the bolt or Allen screw fasteners 184 and 186 (FIGS. 8 and 9) that threadably engage the mounting blocks 84 and 86. By loosening these fasteners, each individual mounting block can be angularly adjusted to a desired acute angle by movement of the fasteners in these slots. Angular movement of each mounting block causes simultaneous angular adjustment of the coiling roll, the drive gear, the idler gear and the driven gear supported on that block only. This independent skew adjustment of the coiling rolls allows specific orientation of each coiling roll to that needed for the specific job. As far as is known, prior coiling roll skew adjustment required both rolls to be simultaneously adjusted equal amounts, see, e.g., the control sectors in U.S. Pat. No. 3,401,557 cited above, operated by a common bias lever.

Each of these gear mount blocks is shown to mount three separate gears plus the coiling rolls. More specifically, a pair of coiling rolls 90 and 92, each with peripheral backup rings and forming rings of known type, is astraddle arbor 23 around which the wire coil forms in known fashion, see, e.g. U.S. Pat. No. 4,569,216 cited above. The front hangers can be adjusted transversely relative to the arbor, to cause a desired amount of bias by the coiling rolls on the wire, and to accommodate the varying size wires by moving the coiling rolls toward or away from the coiling arbor. This is done by adjustment of the transverse threaded rod 131 which extends through both hanger members 24 and 26, and is in threaded engagement with one hanger member 26. Hanger 24 is biased toward arbor 23 and hanger 26 by a compression coil spring 133 around the far end of rod 130, and retained against member 24 by a nut 135 on rod 130. A knurled knob 134 and a locking knob 136 are on the end opposite compression spring 132. The wire (not shown) to be coiled around mandrel 23 is guided by conventional guide wheels 150 and 152 located beneath the coiling rolls (FIG. 3), up to the coiling rolls and the mandrel. The coiled wire is continuously discharged from the free end of the mandrel in known fashion.

At the rear of the coiling rolls and coaxial therewith is a pair of spur gears 94 and 96, respectively, and shafts 90*a* and 92*a*, respectively. These coiling rolls and spur gears are mounted on shafts 90*a* and 92*a* by ball bearings or the equivalent. The shafts extend through and are held fixed in blocks 84 and 86 for mounting of the gears and coiling rolls. Also mounted on blocks 84 and 86 is a pair of idler gears 100 and 102 in continuous engagement with gears 94 and 96, respectively. These idler gears have mounting shafts 100*a* and 102*a*, respectively, (FIG. 9) extending through blocks 84 and 86 and specifically through arcuate slots 84*b* and 86*b*, respectively, for securement by nuts 100*b* and 102*b* on the rear side of the blocks. These arcuate slots are concentric with the axis of gears 94 and 96 so that adjustment of idler gears 100 and 102 in various positions along this arcuate slot will cause the idler gears to constantly stay in engagement with spur gears 94 and 96 on the back of the coiling rolls. This arcuate slot on each block would, if extended, pass through the axis of respective ones of drive gears 110 and 112.

Figure 5:
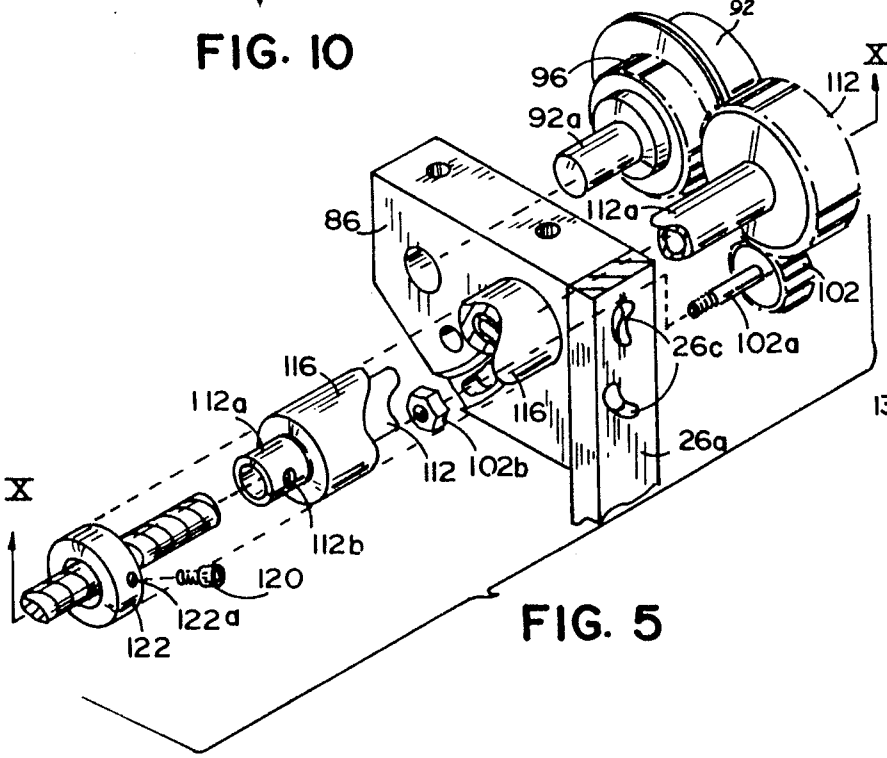
FIG. 5 is a fragmentary side elevational perspective view with one cable connection released from the removable gear.
Figure 10:
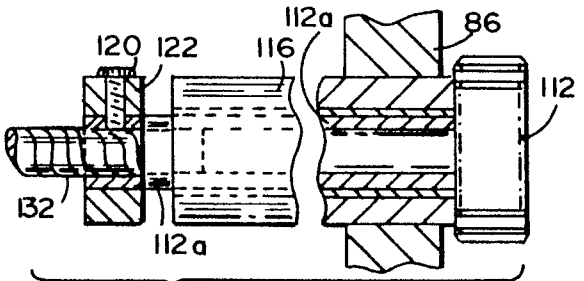
FIG. 10 is an enlarged sectional elevational view of the releasable drive connection of the flexible drive shaft to the removable drive gear.

The gear shafts 110*a* and 112*a* of these drive gears 110 and 112 extend through a pair of fixed bearing sleeves 114 and 116, respectively, (FIG. 6). Sleeves 114 and 116 are affixed to blocks 84 and 86. The rear ends of gear shafts 110*a* and 112*a* are hollow, capable of receiving the forward ends of flexible drive shafts 130 and 132 (FIGS. 5 and 10). Rotational fixing of the flexible drive shafts with these drive gear shafts is with set screws, e.g., 120 (FIG. 5). Each set screw preferably extends through a slidable collar 122 which fits over the rear end of the drive gear shaft, e.g., 112*a*, there being a threaded opening 122*a* in collar 122 to receive the set screw, and a through opening 112*b* in shaft 112*a* to allow passage of the set screw therethrough for secure engagement with the respective flexible drive shaft. By loosening this set screw, the forward end of the flexible drive shaft is releasable from the drive gear shaft, enabling the particular drive gear to be removed frontally by sliding it axially out of its bearing sleeve and substituting another gear of a different diameter and the same size shaft by inserting it through the bearing sleeve from the front. The flexible drive shaft slides into, i.e., is inserted into, the hollow gear shaft of this replacement element, and the set screw is retightened to lock the shafts together. A like replacement is also made for the other drive gear. Then the idler gears are adjusted on their arcuate path by loosening their lock nuts and positioning them in engagement with the replaced drive gears, whether larger or smaller in diameter, such idlers still engaging the spur gears of the coiler rolls. By so doing, the unit allows quick power ratio changes at the coiling rolls to accommodate wire of different diameters and/or tandem or triple coiling.

Operation and use of the invention will be basically apparent to those in the art from the above description. The following is to assure ready and complete understanding thereof.

To coil a particular size wire, whether single, tandem or triple, into a coil of desired diameter, an arbor of the required coil inner diameter is selected and locked into Jacobs chuck 22. The coiling rolls are adjusted axially and angularly relative to each other. Axial adjustment is by loosening split lock blocks 44 and 46 on shafts 28 and 30 by using knobs 40 and 42, then rotating these shafts with knurled knobs 36 and 38 to cause the threaded shafts to travel in collars 32 and 34, thereby axially shifting hangers 24 and/or 26. This axially shifts the coiling rolls as well as the cooperative gears to desired positions. The sliding interfit of drive rings 71 and 73 on pins 50*b* and 52*b* causes the drive connection to be maintained even though one flexible drive shaft is axially offset to the other. Individual angular shift of the coiling rolls is achieved by loosening fasteners 184 and 186, and then shifting the mounting blocks 84 and 86 to independently skew the coiling rolls relative to mandrel 23. The blocks are normally shifted in opposite angular directions to be skewed with respect to each other as well as with respect to the coiling mandrel.

The particular power input to the coiling rolls is achieved by the selected diameter of the drive gears 110 and 112 (compare, for example, the different diameters in FIGS. 3 and 6). The selected drive gears 110 and 112 are inserted in collars 114 and 116, causing the forward ends of flexible drift shafts 130 and 132 to be received in the hollow gear shafts. The lock screws 120 (FIG. 5) are tightened onto the flexible shafts. Next the idler gears are arcuately adjusted to mesh with the inserted drive gears. This is done by loosening the nuts 100*b* and 102*b*, shifting the idler gears and shafts and tightening the nuts.

Power is then applied to spindle shaft 14 via pulleys 16 to drive the assembly. Specifically, the drive arbor rotates chuck 22 and coiling mandrel 23, as well as rotating drive rolls 50 and 52 via arbor 20. These rotate flexible drive shafts 130 and 132 to drive gears 110 and 112. Gears 110 and 112 rotate idler gears 100 and 102 which power spur driven gears 94 and 96 to coiling rolls 90 and 92. The wire fed around guide wheels 150 and 152 is thereby fed to the coiling rolls, coiled around mandrel 23 and discharged off the free axial end thereof as illustrated in detail in FIGS. 4 and 5 of U.S. Pat. No. 4,569,216, for example.

The inventive embodiment set forth in detail is the preferred embodiment as an example. Conceivably, those in the art could modify this specific structure to suit a particular environment. The invention is not intended to be limited to this specific structure, but only by the scope of the appended claims and the reasonably equivalent structures to those defined therein.

The embodiments of the invention in which an exclusive property or privilege is claimed are defined as follows:

1. A wire coiling machine comprising:

a rotary powered spindle;

a pair of driven rolls in operative relation with one end of said spindle and astraddle thereof;

a coiling mandrel at the opposite end of said spindle;

a pair of coiling rolls astraddle said coiling mandrel in operative coiling association therewith;

flexible drive shafts operably associated with said driven rolls;

a pair of drive gears connected to said flexible drive shafts;

a pair of idler gears intermeshed respectively with said pair of drive gears;

a pair of driven gears coaxial with and in driving association with said coiling rolls, said driven gears being intermeshed respectively with said idler gears, whereby driving of said driven rolls by said spindle will drive said flexible drive shafts, said drive gears, said idler gears and said driven gears, to drive said coiling rolls;

said drive gears having a removable connection for removal and substitution of drive gears of another diameter; and said idler gears being shiftable relative to said drive gears to accommodate different diameter drive gears while still meshing with said driven gears, so that the power to said coiling rolls can be varied.

2. The coiling machine in claim 1 wherein said connection of said flexible drive shafts with said drive gears is disconnectable for removal and substitution of said drive gears.

3. The coiling machine in claim 2 wherein said driven rolls have an axially movable connection to said flexible drive shafts allowing axial movement of said flexible drive shafts relative to said drive gears for disconnection from said drive gears.

4. The coiling machine in claim 3 wherein said driven rolls have radially positioned, circumferentially spaced, axially extending projections, and said flexible drive shafts have radially positioned, circumferentially spaced, axially projecting sleeves in slidable relationship with said projections to facilitate said axial movement.

5. The coiling machine in claim 1 including gear supports, wherein said drive gears include drive gear shafts which are received by said gear supports, said flexible drive shafts connect to said drive gear shafts, and said connections of said flexible drive shafts to said drive gear shafts are axially disconnectable.

6. The coiling machine in claim 5 wherein said gear shafts are hollow, said flexible drive shafts have ends received by said hollow gear shafts, and including releasable locking means for locking said flexible drive shafts to said hollow gear shafts.

7. The coiling machine in claim 6 wherein said locking means comprises locking set screws.

8. The coiling machine in claim 1 including support mounts receiving said gear drive shafts, mounting said idler gears, and mounting said coaxial gears.

9. The coiling machine in claim 8 wherein said support mounts have tracks for adjustable movement of said idler gears to accommodate different diameter drive gears.

10. The coiling machine in claim 9 wherein said tracks are arcuate and concentric with the axes of said driven gears to maintain engagement therewith when adjusted.

11. The coiling machine in claim 9 wherein said tracks are on an arcuate path, the arc of which has an imaginary extension passing through the axis of said drive gear and has a center of curvature coaxial with said driven gear.

12. A wire coiling machine comprising:

a framework;

a coiling mandrel;

a pair of coiling rolls astraddle said mandrel in operative coiling association therewith;

a pair of driven gears coaxial with and in driving association with said coiling rolls;

drive gear means for driving said driven gears and including a pair of drive gears having gear support and drive shafts; and said drive gears and said gear support and drive shafts being removable for substitution by drive gears of another diameter whereby power to said coiling rolls can be varied.

13. The coiling machine in claim 12 including a pair of gear support mounts mounting said coiling rolls, said driven gears and said drive gear means;

said supports being pivotally mounted to said framework in a manner allowing movement toward and away from said mandrel;

said supports having shaft receiving openings, and said drive gear shafts having a sliding interfit in said shaft receiving openings.

14. The coiling machine in claim 13 wherein said flexible drive shafts have a releasable connection to said drive gear shafts.

15. The coiling machine in claim 14 wherein said drive gear shafts have an axial opening to receive said flexible drive shafts.

16. The coiling machine in claim 15 wherein said supports are biased toward said mandrel.

17. The coiling machine in claim 13 wherein said drive gear means also includes idler gears mounted on said supports and being shiftable to accommodate different diameter drive gears.

18. The coiling machine in claim 17 wherein said idler gears are arcuately shiftable on said supports.

19. A wire coiling machine comprising:

a framework;

a pair of hangers on said framework including a pair of support blocks;

a spindle having a coiling mandrel;

coiling rolls mounted on said support blocks astraddle of said mandrel;

drive gear means mounted on each said support block for driving said coiling rolls;

flexible drive shafts connected to said drive gear means;

each said drive gear means including a removable gear enabling the gear ratio to be altered by a substitute gear of different diameter, and including a shiftable gear for achieving gear meshing of said drive gear means before and after the gear substitution.

20. The wire coiling machine of claim 19 including means for axially adjusting each said support block to axially shift the respective drive gear means and coiling rolls.

21. The wire coiling machine of claim 20 including skew control means for independently angularly shifting each said support block to a selected angle for obtaining a selected skewed relationship of the respective coiling rolls to said coiling mandrel.

22. The wire coiling machine of claim 21 wherein each said drive gear means has a releasable connection to the respective one of said flexible drive shafts.

23. The wire coiling machine of claim 21 including means for transversely adjusting said coiling rolls relative to said coiling mandrel.

24. The wire coiling machine of claim 21 wherein said skew control means comprises angular slots in said support blocks and fasteners through said slots.

* * * * *